US008613343B2

(12) United States Patent
Aulanko et al.

(10) Patent No.: US 8,613,343 B2
(45) Date of Patent: Dec. 24, 2013

(54) ELEVATOR

(75) Inventors: Esko Aulanko, Kerava (FI); Jorma Mustalahti, Hyvinkaa (FI); Johannes De Jong, Jarvenpaa (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 13/525,724

(22) Filed: Jun. 18, 2012

(65) Prior Publication Data

US 2012/0247877 A1 Oct. 4, 2012

Related U.S. Application Data

(60) Division of application No. 12/805,934, filed on Aug. 25, 2010, now Pat. No. 8,225,909, which is a division of application No. 11/649,810, filed on Jan. 5, 2007, now Pat. No. 7,806,237, which is a continuation of application No. PCT/FI2005/000310, filed on Jul. 1, 2005.

(30) Foreign Application Priority Data

Jul. 30, 2004 (FI) ..... 20041042

(51) Int. Cl.
*B66B 11/08* (2006.01)

(52) U.S. Cl.
USPC ..... 187/264; 187/266

(58) Field of Classification Search
USPC ..... 187/264, 266
See application file for complete search history.

(56) References Cited

U.S. PATENT DOCUMENTS 799,337 A 9/1905 Hiss et al.
912,256 A 2/1909 Neenan
988,016 A * 3/1911 Neenan ..... 187/264

(Continued)

FOREIGN PATENT DOCUMENTS

CN 1420839 A 5/2003
DE 19507628 9/1996

(Continued)

OTHER PUBLICATIONS

Chinese First Office Action dated Mar. 30, 2009, for corresponding Chinese Patent Application No. 200580025901.5 (with English language abstract).

*Primary Examiner* — William E Dondero
*Assistant Examiner* — Minh Truong
(74) *Attorney, Agent, or Firm* — Harness, Dickey & Pierce, P.L.C.

(57) ABSTRACT

An elevator may include an elevator car, a set of hoisting ropes, a traction sheave, and a compensating device. The set of hoisting ropes may include first and second rope portions. The elevator car may include one or more first diverting pulleys from which the first rope portions extend upward. The elevator car may include one or more second diverting pulleys from which the second rope portions extend downward. The first rope portions may be under a first rope tension. The second rope portions may be under a second rope tension that is different from the first rope tension. The compensating device may act in substantially opposite directions on the first and second rope portions. The compensating device may produce an auxiliary force acting substantially in a same direction as the first rope tension.

5 Claims, 7 Drawing Sheets

(56) References Cited

U.S. PATENT DOCUMENTS

Figure 1:
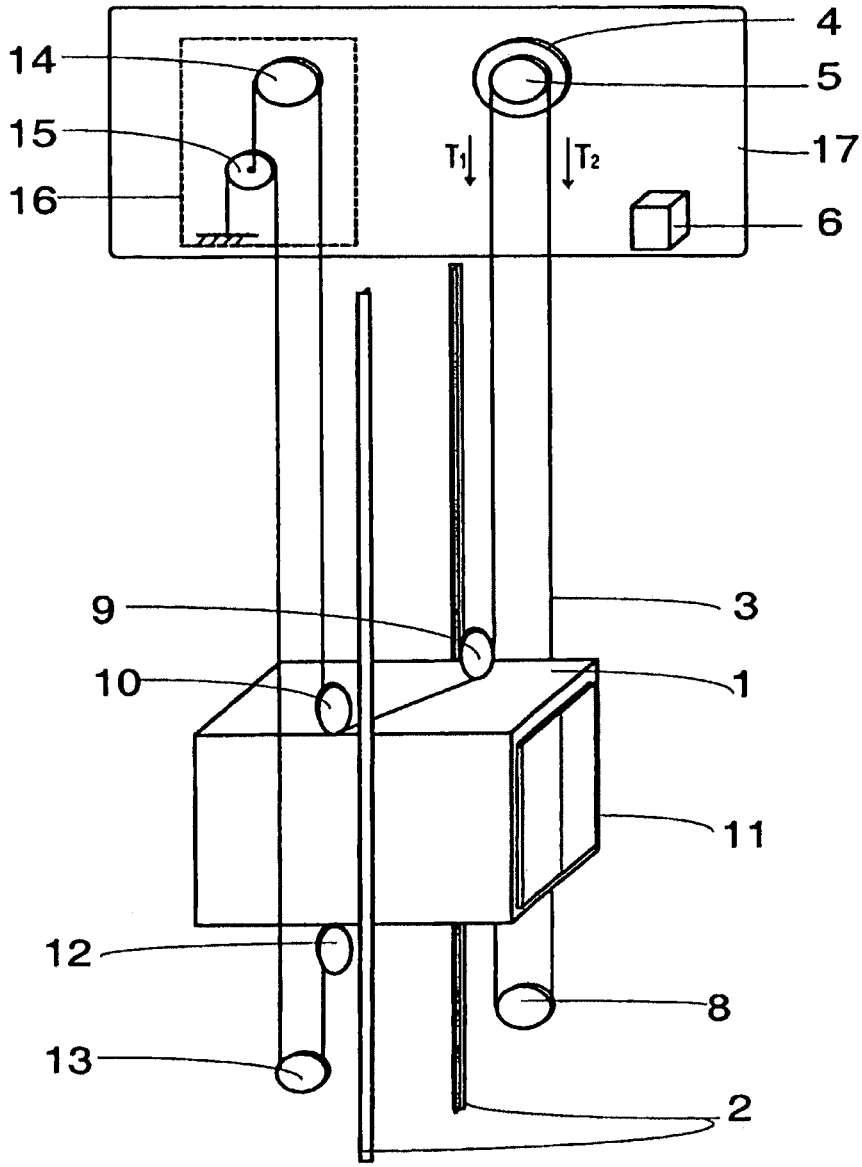

| | | | | |
|---|---|---|---|---|
| 718,762 | A | 1/1993 | Hiss | |
| 5,398,781 | A | 3/1995 | Biewald et al. | |
| 5,437,347 | A | 8/1995 | Biewald et al. | |
| 5,788,018 | A | 8/1998 | Mendelsohn | |
| 5,861,084 | A | 1/1999 | Barker et al. | |
| 5,878,847 | A | 3/1999 | Mustalahti et al. | |
| 6,193,017 | B1 | 2/2001 | Koster | |
| 6,431,321 | B2 | 8/2002 | Ach | |
| 6,786,306 | B2 | 9/2004 | Tiner | |
| 7,481,299 | B2 | 1/2009 | Mustalahti et al. | |
| 7,650,972 | B2 | 1/2010 | Aulanko et al. | |
| 964,889 | A1 | 7/2010 | Venn | |
| 7,802,658 | B2 | 9/2010 | Aulanko et al. | |
| 8,235,179 | B2 * | 8/2012 | Valjus et al. | 187/264 |
| 2004/0035645 | A1 | 2/2004 | Ormann | |
| 2005/0217944 | A1 * | 10/2005 | Aulanko et al. | 187/266 |
| 2005/0284705 | A1 * | 12/2005 | Aulanko et al. | 187/266 |
| 2006/0196730 | A1 * | 9/2006 | Mustalahti et al. | 187/266 |
| 2006/0243531 | A1 | 11/2006 | Bjorni et al. | |
| 2006/0243532 | A1 | 11/2006 | Aulanko et al. | |

FOREIGN PATENT DOCUMENTS

| | | | | |
|---|---|---|---|---|
| EP | 0631967 | | 1/1995 | |
| EP | 0631968 | | 1/1995 | |
| FR | 2823734 | A1 | 10/2002 | |
| GB | 1442584 | | 2/1975 | |
| JP | 03-264482 | | 11/1991 | |
| JP | 06-80345 | | 3/1994 | |
| JP | 07-53156 | | 2/1995 | |
| JP | 09-124254 | | 3/1997 | |
| JP | 11-209032 | | 8/1999 | |
| JP | 2000-86129 | | 3/2000 | |
| JP | 2004/67365 | | 3/2004 | |
| WO | WO 2004/041704 | | 5/2004 | |
| WO | WO 2004/050526 | A1 | 6/2004 | |
| WO | WO 2004/094287 | | 11/2004 | |
| WO | WO 2005090217 | A2 * | 9/2005 | B66B 7/10 |
| WO | WO 2005092770 | A2 * | 10/2005 | |

* cited by examiner

ELEVATOR

This application is a divisional application of U.S. patent application Ser. No. 12/805,934, filed on Aug. 25, 2010 (published as U.S. Patent Application Publication No. 2011/0017551 A1 on Jan. 27, 2011), which is a divisional application of U.S. patent application Ser. No. 11/649,810, filed on Jan. 5, 2007 (now U.S. Pat. No. 7,806,237), which is a continuation of PCT/FI2005/000310, filed on Jul. 1, 2005, which claims priority to FI 20041042 filed on Jul. 30, 2004; the entire contents of all of the above applications are incorporated by reference.

The present invention relates to an elevator.

One of the objectives in elevator development work is to achieve efficient and economical utilization of building space. In recent years, this development work has produced various elevator solutions without machine room, among other things. Good examples of elevators without machine room are disclosed in specifications EP 0 631 967 (A1) and EP 0 631 968. The elevators described in these specifications are fairly efficient in respect of space utilization as they have made it possible to eliminate the space required by the elevator machine room in the building without a need to enlarge the elevator shaft. In the elevators disclosed in these specifications, the machine is compact at least in one direction, but in other directions it may have much larger dimensions than a conventional elevator machine.

In these basically good elevator solutions, the space required by the hoisting machine limits the freedom of choice in elevator lay-out solutions. Space is needed for the arrangements required for the passage of the hoisting ropes. It is difficult to reduce the space required by the elevator car itself on its track and likewise the space required by the counterweight, at least at a reasonable cost and without impairing elevator performance and operational quality. In a traction sheave elevator without machine room, mounting the hoisting machine in the elevator shaft is often difficult, especially in a solution with machine above, because the hoisting machine is a sizeable body of considerable weight. Especially in the case of larger loads, speeds and/or travel heights, the size and weight of the machine are a problem regarding installation, even to the extent that the required machine size and weight have in practice limited the sphere of application of the concept of elevator without machine room or at least retarded the introduction of said concept in larger elevators. In modernization of elevators, the space available in the elevator shaft often limits the area of application of the concept of elevator without machine room. One prior-art solution is disclosed in publication U.S. Pat. No. 5,788,018, in which the elevator car is suspended with a suspension ratio of 1:1, and in which various tensioning devices are used to tension the continuous hoisting rope. The compensation sheave described in this publication is regulated by a separate control system, said system being controlled by means of an external control, which system requires regulation implemented by means of a complex external control. A recent traction sheave elevator solution with no counterweight, WO2004041704, presents a viable solution in which movement of the elevator car in the elevator is based on traction friction from the hoisting ropes of the elevator by means of a traction sheave. This elevator solution is primarily aimed at low buildings and/or buildings with a low travel height. The problems that are solved in this publication are mainly applicable for use in relatively low buildings, and although the concepts also apply to larger travel heights, large travel heights and higher speeds introduce new problems to be solved. In prior-art elevator solutions without counterweight, the tensioning of the hoisting rope is implemented by means of a weight or spring, and this is not an attractive approach to implementing the tensioning of the hoisting rope.

Another problem with elevator solutions without counterweight, e.g., when long ropes are also used due to, e.g., a large travel height or high-rise buildings and/or the length of the rope due to large suspension ratios, is compensation of the elongation of the ropes and the fact that, due to rope elongation, the friction between the traction sheave and the hoisting ropes is insufficient for the operation of the elevator.

The object of the present invention is to achieve at least one of the following objectives. On the one hand, it is an aim of the invention to develop the elevator without machine room further so as to allow more effective space utilization in the building and elevator shaft than before. This means that the elevator should be capable of being installed in a fairly narrow elevator shaft if necessary. One objective is to achieve an elevator in which the hoisting rope has a good grip/contact on the traction sheave. A further aim of the invention is to achieve an elevator solution without counterweight without compromising the properties of the elevator. An additional objective is to eliminate rope elongations. Yet a further objective of the invention is to achieve an elevator by means of which it is possible to implement an elevator without counterweight in high-rise buildings and/or a fast elevator without counterweight.

The object of the invention should be achieved without compromising the possibility of varying the basic elevator lay-out.

The elevator of the invention is discussed below. Some embodiments of the invention are characterized by what is disclosed in the claims. Some inventive embodiments are also discussed in the descriptive section of the present application. The inventive content of the application can also be defined differently than in the claims presented below. The inventive content may also consist of several separate inventions, especially if the invention is considered in the light of explicit or implicit sub-tasks or from the point of view of advantages or categories of advantages achieved. In this case, some of the attributes contained in the claims below may be superfluous from the point of view of separate inventive concepts. The various embodiments of the invention and the features and details of the embodiment examples can be used in conjunction with each other. For example, locking of the movement of the compensating system can be implemented in conjunction with a shut-off valve or mechanically.

By applying the invention, one or more of the following advantages, among others, can be achieved:

- One advantage achieved by means of the elevator of the invention is that many different lay-out solutions are possible such as, e.g., different car shapes that have not earlier been achieved with conventional elevators, and additionally through-type car solutions are possible.
- The elevator of the invention is an economical solution because the rope quantity needed in it is smaller than in a conventional elevator without counterweight solution.
- Regardless of the travel height a compensation rope is not needed in the elevator of the invention as it is in elevators with counterweights, which becomes appreciably advantageous especially in the elevators of high-rise buildings.
- Using a small traction sheave, a very compact elevator and/or elevator machine is achieved.
- A compact machine size and thin, substantially round ropes permit the elevator machine to be relatively freely placed in the shaft and in the machine room of the elevator. Thus, the elevator solution of the invention can be implemented in a fairly wide variety of ways in the case of both elevators with machine above and elevators with machine below.

The elevator machine can be advantageously placed between the car and a shaft wall.

All or at least part of the weight of the elevator car can be carried by the elevator guide rails.

Applying the invention allows effective utilization of the cross-sectional area of the elevator shaft.

With rope diameters of about 6 mm or 8 mm or 13 mm, fairly large and fast elevators according to the invention can be achieved.

The use of a small traction sheave makes it possible to use a smaller elevator drive motor, which means reduced drive motor acquisition/manufacturing costs.

The invention can be applied in gearless and geared elevator motor solutions.

The invention can be applied in both elevators without machine room and elevators with machine room.

In the invention a better grip and a better contact between the hoisting ropes and the traction sheave are achieved by increasing the contact angle between them.

The space saving potential of the elevator of the invention is considerably increased as the space required by the counterweight can be at least partially eliminated.

As a result of a lighter and smaller elevator system, energy savings and therefore cost savings are achieved.

The placement of the machine in the shaft and in the machine room can be relatively freely chosen as the space required by the counterweight and counterweight guide rails can be used for other purposes.

In the elevator solution of the invention, it is possible to dispose all ropes in the shaft on one side of the elevator car; for example, in the case of rucksack type solutions, the ropes can be arranged to run behind the elevator car in the space between the elevator car and the back wall of the elevator shaft.

The invention makes it easy to implement scenic-type elevator solutions as well.

Since the elevator solution of the invention does not have a counterweight, it is possible to implement elevator solutions in which the elevator car has doors in several walls, in an extreme case even in all the walls of the elevator car. In this case, the guide rails of the elevator car are disposed at the corners of the elevator car.

The elevator solution of the invention can be implemented with several different machine solutions.

The suspension of the car can be implemented using almost any suitable suspension ratio.

Compensation of rope elongations by means of a compensating system according to the invention is a cheap and simple structure to implement.

Using the compensating system of the invention, it is possible to achieve a constant ratio between the forces $T_1/T_2$ acting on the traction sheave.

The ratio between the forces $T_1/T_2$ acting on the traction sheave is independent of the load.

By using the compensating system of the invention, unnecessary stress on the machine and ropes can be avoided.

By using the compensating system of the invention, the relation between the forces $T_1/T_2$ can be optimized to achieve a desired value.

In addition, the compensating system of the invention make it unnecessary to stress the hoisting ropes in order to ensure friction between the traction sheave and the hoisting rope by loads larger than necessary, and consequently the useful life of the hoisting ropes is increased and their damage susceptibility is reduced.

By using a compensating system according to the invention, it is possible to compensate even large rope elongations, especially in the case of high travel heights.

In an elevator according to the invention, creeping of the elevator car in a starting and/or stopping situation can be better prevented.

The useful life of the hoisting ropes of the elevator increases and the risk of defect is decreased as there is better control of the movement of the hoisting ropes by means of the compensating system according to the invention and its locking arrangement.

The operating reliability of the elevator is better in an elevator according to the invention and by means of the invention it is easy to ensure that the compensating system operates in the manner desired.

More than one of the elevators according to the invention can be disposed to travel in the same elevator shaft one above the other.

The compensating system of the elevator can easily be implemented as a hydraulic compensating system.

Also force divergences occurring in the elevator can easily be equalized by means of a hydraulic compensating system.

The information of the load weighing device of the elevator is easily ascertained by means of a pressure gauge fitted to the hydraulic compensating system.

Force changes occurring in the elevator can be dampened or the compensating system of the elevator can be locked in position preferably by means of a hydraulic locking means/dampening means.

The primary area of application of the invention is elevators designed for the transportation of people and/or freight. A typical area of application of the invention is in elevators whose speed range is higher than about 1 m/s, but may also be lower than 1.0 m/s. For example, an elevator having a traveling speed of 6 m/s and/or an elevator having a traveling speed of 0.6 m/s is easy to implement according to the invention. The elevator according to the invention is also applicable for use in high and very high buildings in elevator solutions both with machine room and without machine room. Fast elevator solutions can also be implemented by means of an elevator according to the invention.

In both passenger and freight elevators many of the advantages achieved through the invention are pronouncedly brought out even in elevators for only 2-4 people, and distinctly brought out in elevators for 6-8 people (500-630 kg).

In the elevator of the invention, normal elevator hoisting ropes, such as generally used steel ropes, are applicable. In the elevator, it is possible to use ropes made of artificial materials and ropes in which the load-bearing part is made of artificial fiber, such as, e.g., so-called "aramid ropes", which have recently been proposed for use in elevators. Applicable solutions also include steel-reinforced flat ropes, especially because they allow a small deflection radius. Particularly well applicable in the elevator of the invention are elevator hoisting ropes twisted, e.g., from round and strong wires. From round wires, the rope can be twisted in many ways using wires of different or equal thickness. In ropes well applicable in the invention, the wire thickness is below 0.4 mm on average. Well applicable ropes made from strong wires are those in which the average wire thickness is below 0.3 mm or even below 0.2 mm. For instance, thin-wired and strong 4 mm ropes can be twisted relatively economically from wires such that the mean wire thickness in the finished rope is in the range of 0.15 . . . 0.25 mm, while the thinnest wires may have a thickness as small as only about 0.1 mm. Thin rope wires can easily be made very strong. In the invention, rope wires having a strength greater than 2000/mm$^2$ can be used. A suitable range of rope wire strength is 2300-2700 N/mm$^2$. In principle, it is possible to use rope wires having a strength of up to about 3000 N/mm$^2$ or even more. It is also possible to use conventional elevator hoisting ropes in the elevator of the invention. In an elevator with a suspension ratio of 2:1, for example, having a traveling speed of about 6 m/s and with the mass of the car plus maximum load being about 4000 kg, only six elevator hoisting ropes each of 13 mm in diameter are needed. Preferred areas of application for an elevator according to the invention with a 2:1 suspension ratio are elevators whose speed is in a range above 4 m/s. One design criterion in the elevator of the invention has been to keep rope speeds below 20 m/s. However, when the rope speed is about 10 m/s, the speed range of the elevator is one in which the operation and behavior of the rope on the traction sheave of the elevator are fairly well known. A preferred solution of the elevator of the invention is an elevator without machine room, but also solutions with a machine room are easy to implement by means of the invention. In high-rise buildings, the absence of a machine room is not necessarily significant, but if even 10-20%, or even higher, savings in shaft space are achieved by means of elevators according to the invention, really significant advantages in utilizing the surface area of a building will be achieved.

Preferred embodiments of an elevator without counterweight according to the invention are, for example, with a suspension ratio of 4:1 and using conventional elevator hoisting ropes of 8 mm in diameter and with the speed of the elevator being, e.g., 3 m/s and with the weight of the elevator car plus maximum load being 4000 kg, in which case only eight hoisting ropes are needed. Another example of a preferred embodiment is an elevator without counterweight having a suspension ratio of 6:1, the speed of said elevator being 1.6 m/s, and in which conventional ropes of 8 mm in diameter are used, and with the mass of the elevator car of the elevator plus maximum load being at most 3400 kg, in which case only 5 hoisting ropes are needed.

The elevator car in the elevator of the invention is suspended by means of hoisting ropes. The hoisting ropes consist of a single rope or several parallel ropes. The elevator has a traction sheave which moves the elevator car by means of the hoisting ropes. The elevator has rope portions of the hoisting ropes going upwards and downwards from the elevator car and the rope portions going upwards from the elevator car are under a first rope tension ($T_1$) and the rope portions going downwards from the elevator car are under a second rope tension ($T_2$). The elevator has a compensating system acting on the hoisting ropes for equalizing and/or compensating the rope tension and/or rope elongation and/or for keeping the ratio ($T_1/T_2$) between the first rope tension and the second rope tension substantially constant. Additional force may be arranged for the compensating system, said additional force being substantially directed in the same direction as the first rope tension $T_1$. By means of the additional force, the second rope tension $T_2$ is increased in relation to the first rope tension $T_1$. The contact angle in the elevator can be increased by means of a rope sheave functioning as a diverting pulley, which also increases the grip between the traction sheave and the hoisting ropes. A contact angle of over 180° between the traction sheave and the hoisting rope is achieved by using one or more diverting pulleys. The need to compensate the rope elongation arises from the friction requirements, to ensure that a grip sufficient for operation and safety of the elevator exists between the hoisting rope and the traction sheave. On the other hand, it is essential in respect of elevator operation and safety that the rope portion below the elevator car in an elevator solution without counterweight should be kept sufficiently tight. This cannot necessarily be achieved using a spring or a simple lever.

The compensating system in an elevator according to the invention can be placed at least partly in the machine room of the elevator or entirely in the machine room or entirely in the elevator shaft. An advantageous location in the elevator is one in which there is good accessibility to the compensating system and servicing/installation activities are easy to perform. In this case the location of the compensating system in the elevator is, e.g., such that the compensating system is at least partly in the proximity of the hoisting machine of the elevator. In high and very high buildings the compensating system is often long, because the amount of rope elongation to be equalized is long, in which case the equalization distance of the compensating system may be very long also. The compensating system can, for instance, extend at least partly to the upper part of the elevator shaft or to the machine room. Preferably the compensating system is at least partly at the level of the machine of the elevator, at the level of the uppermost floor of the building or at a level above that so that, e.g., a serviceman can reach and access it on the uppermost level while standing, or the compensating system is located so that it can be reached from the roof of the elevator car when the elevator car is in its uppermost position.

Double-decker elevator solutions, or elevator solutions in which there is more than one elevator car in the same elevator shaft, can be implemented by means of the elevator according to the invention.

Figure 2:
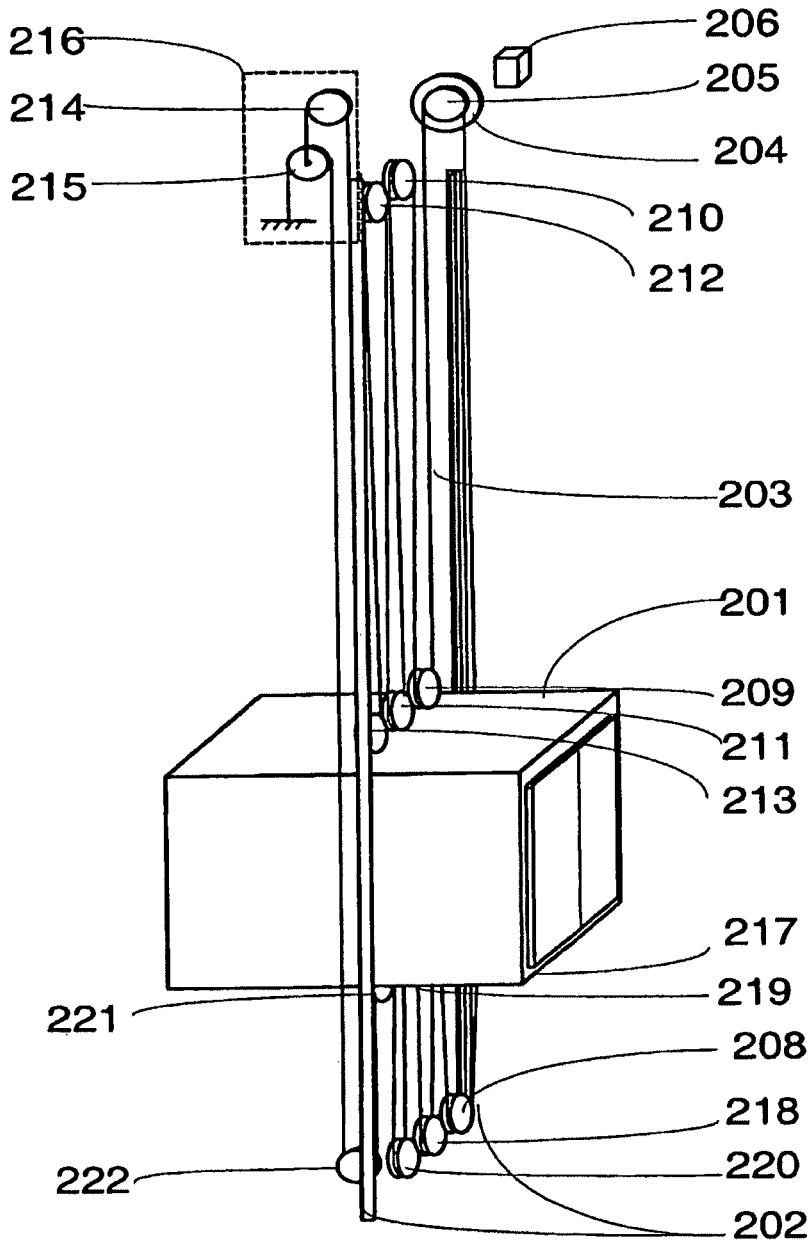
Figure 3:
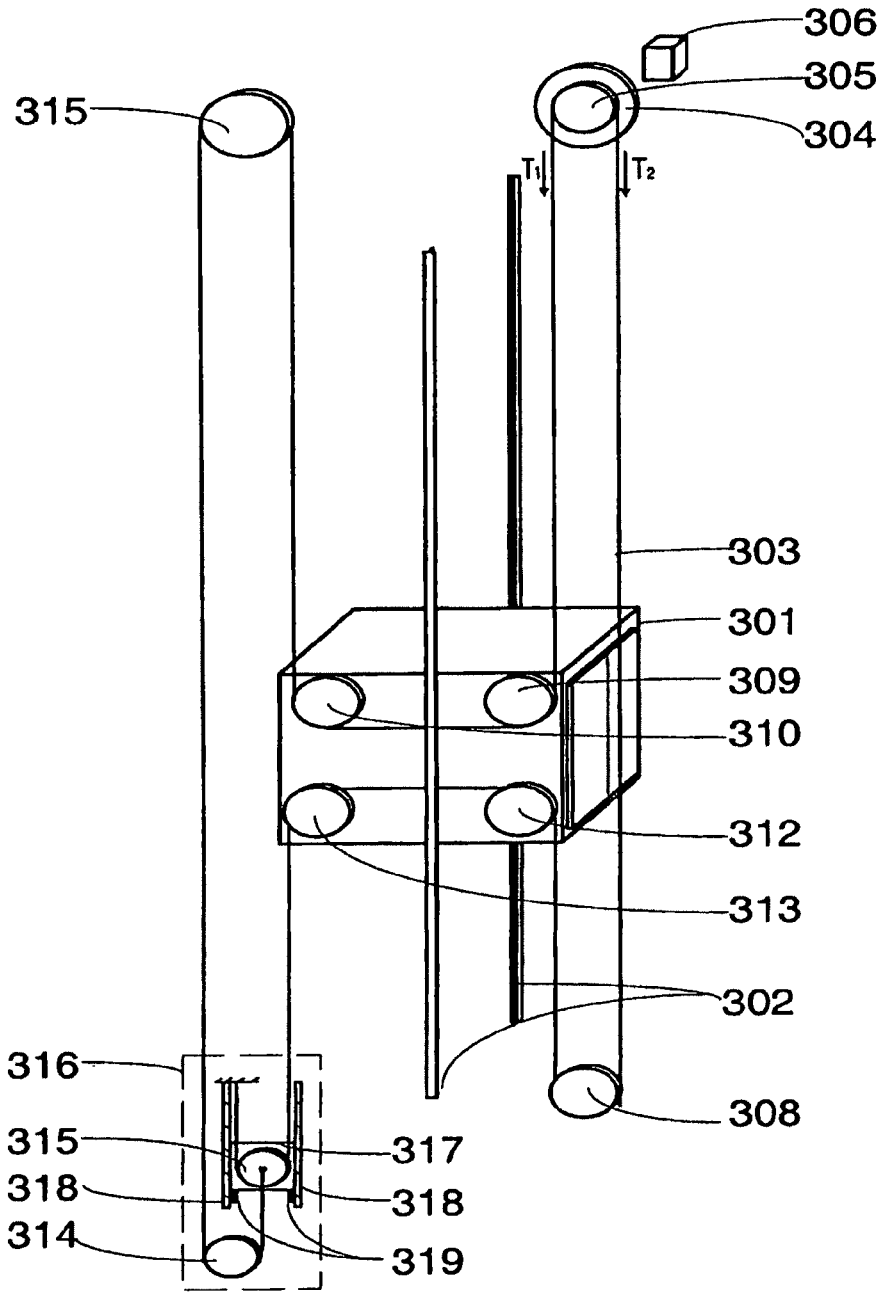
Figure 4:
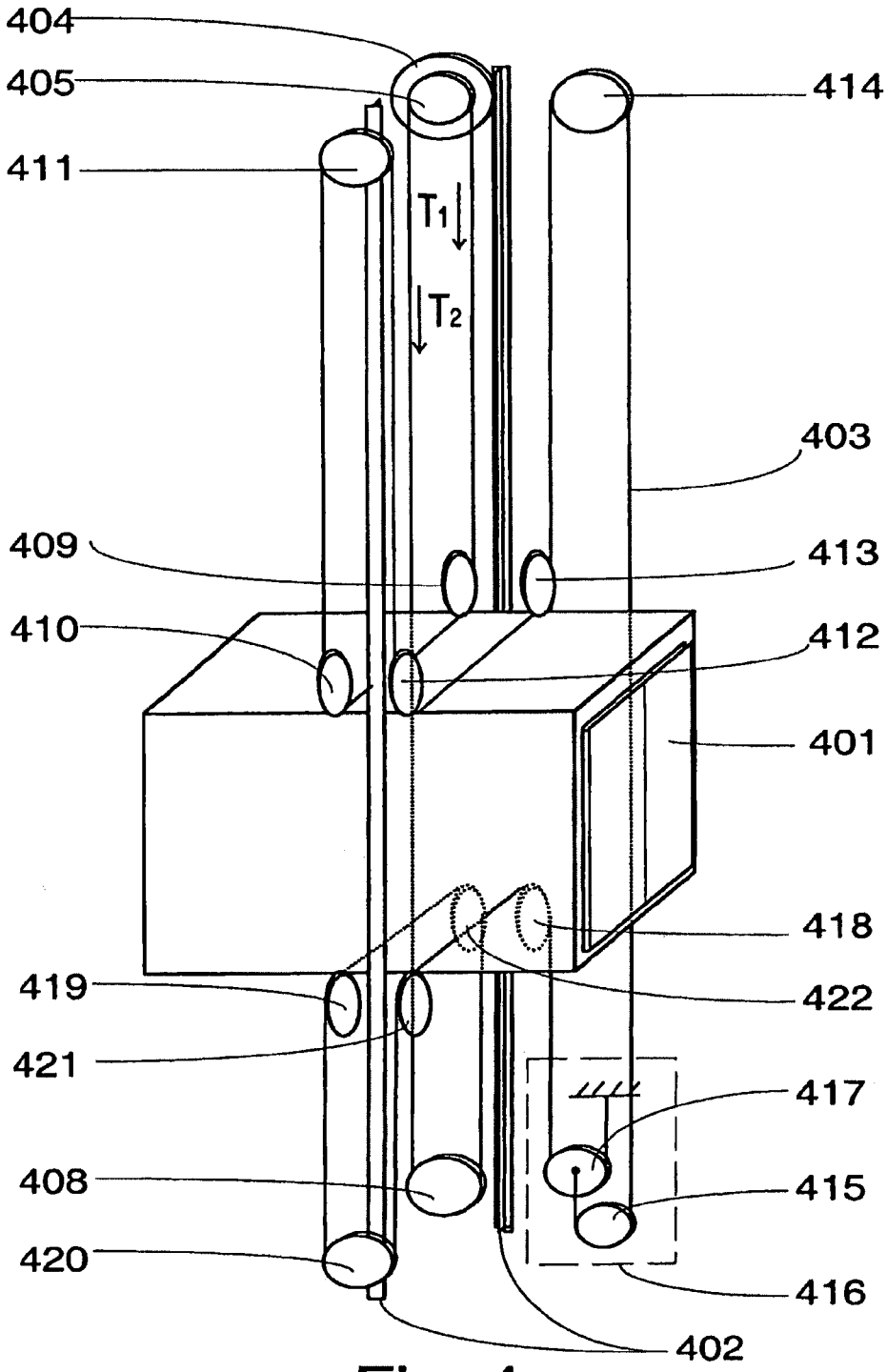
Figure 5:
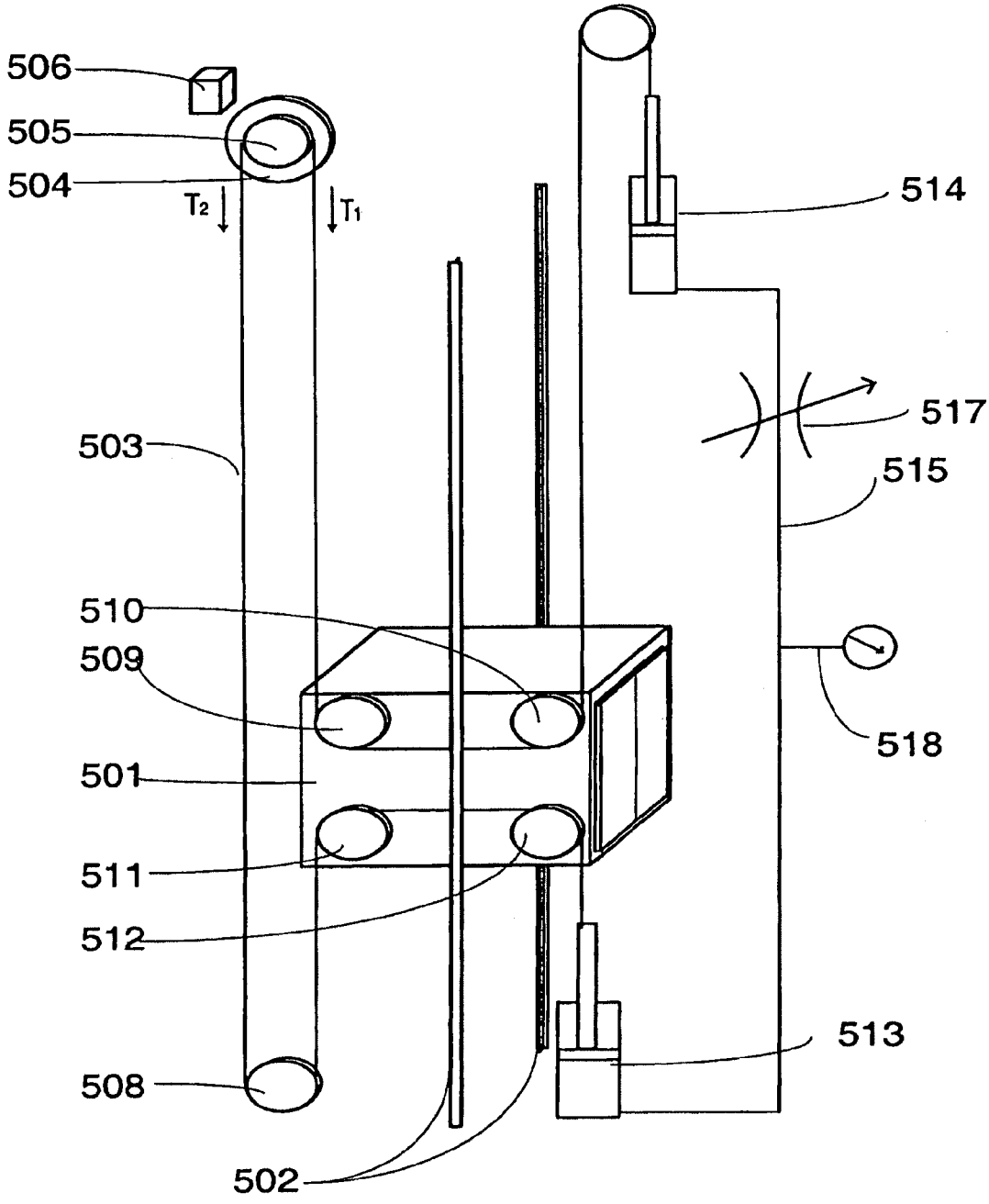
Figure 6:
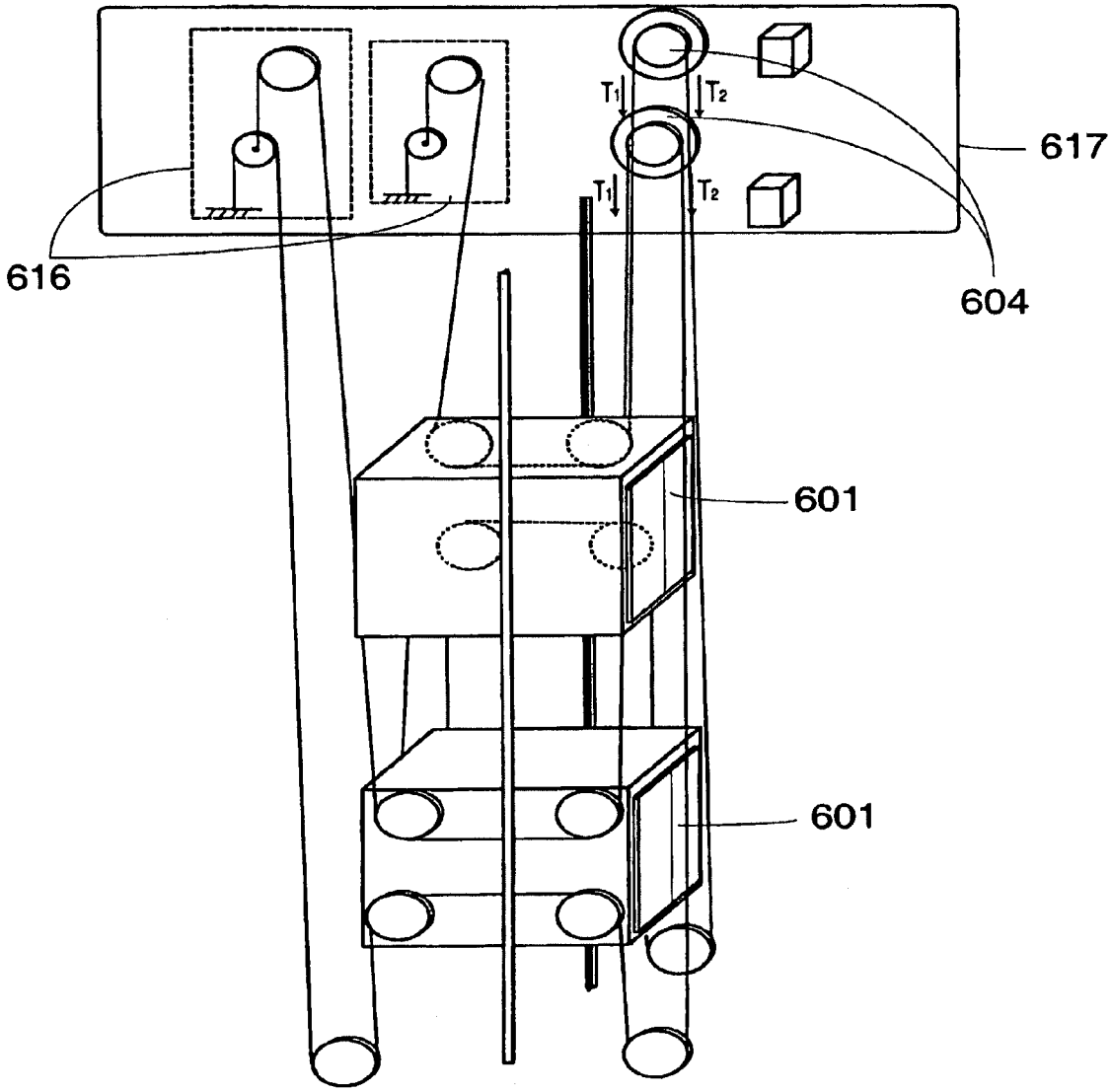
Figure 7:
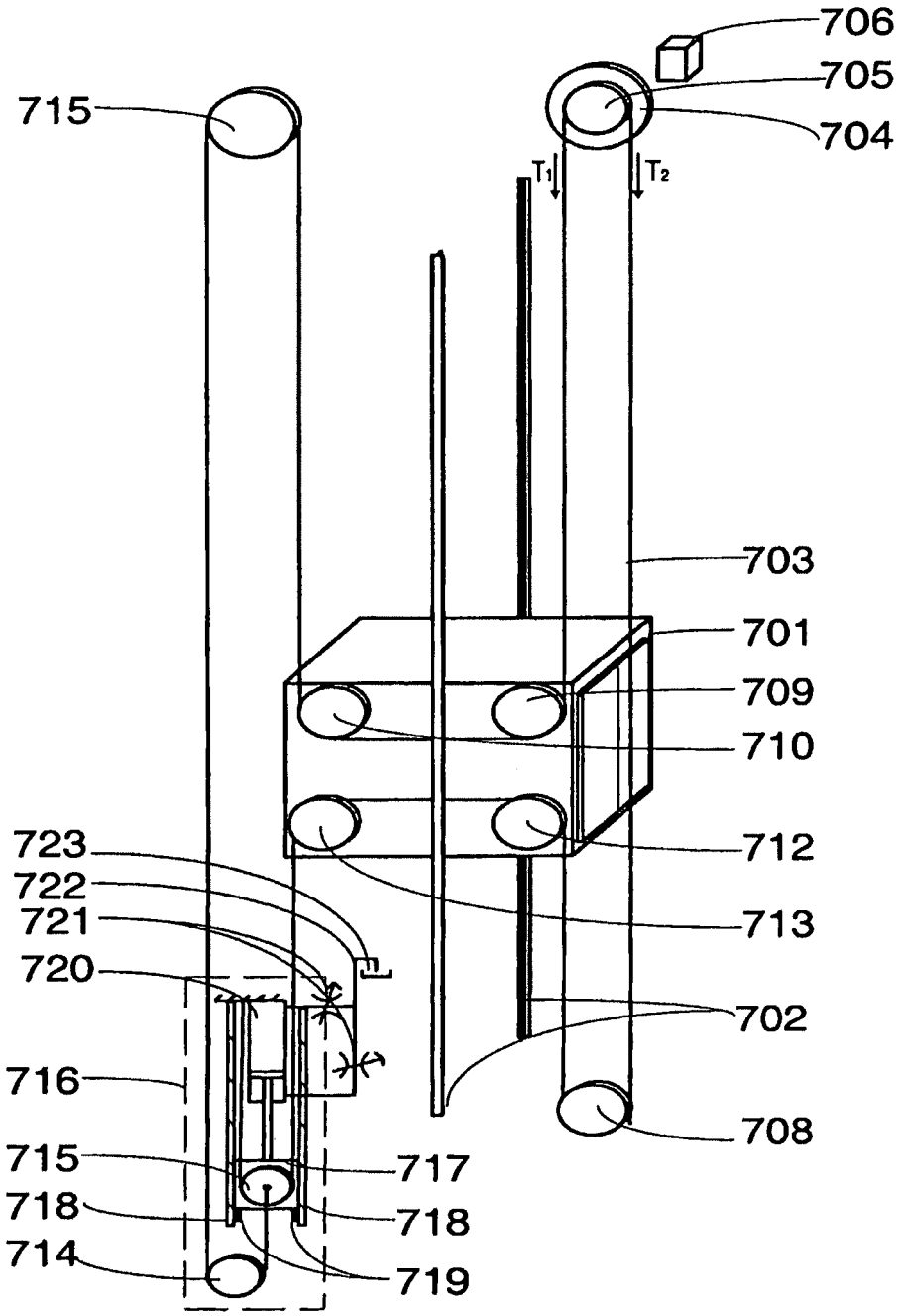

In the following, the invention will be described in detail by the aid of a few examples of its embodiments with reference to the attached drawings, wherein FIG. 1 is a diagram representing a traction sheave elevator without counterweight according to the invention, FIG. 2 presents a diagram of another a traction sheave elevator without counterweight according to the invention, FIG. 3 presents a diagram of a third traction sheave elevator without counterweight according to the invention and a compensating system according to the invention, FIG. 4 presents a diagram of a fourth traction sheave elevator without counterweight according to the invention, FIG. 5 presents a diagram of another a traction sheave elevator without counterweight according to the invention and a compensating system, FIG. 6 presents a diagram of an elevator solution according to the invention, in which one or more elevators travel in the same elevator shaft one above the other, and FIG. 7 presents a diagram of a hydraulic locking/dampening means of a compensating system in an elevator.

FIG. 1 presents a diagrammatic illustration of a traction sheave elevator without counterweight according to the invention, in which a compensating system according to the invention is situated in the upper part of the shaft, i.e. in the case of FIG. 1 in the machine room 17. The elevator is an elevator with machine room, with a drive machine 4 placed in the machine room 17. The elevator shown in the figure is a traction sheave elevator without counterweight, in which the elevator car 1 moves along guide rails 2. In elevators with a large travel height, the elongation of the hoisting rope involves a need to compensate the rope elongation, which has to be done reliably within certain permitted limit values. In that case it is essential in respect of elevator operation and safety that the hoisting rope portion below the elevator car should be kept sufficiently tight. In the rope force compensating system 16 of the invention presented in FIG. 1, a very long movement for compensating rope elongation is achieved. This enables compensation of also large elongations, which is not often possible with simple lever solutions or with spring solutions. The compensating system 16 of the invention shown in FIG. 1 keeps the rope tensions $T_1$ and $T_2$ acting on the traction sheave at a constant ratio of $T_1/T_2$. In the case presented in FIG. 1 the $T_1/T_2$ ratio is 2/1. With even suspension ratios above and below the elevator car, the compensating system 16 is disposed in the machine room or in the elevator shaft or in another place suitable for the purpose that is not connected to the elevator car, and with odd suspension ratios above and below the elevator car the compensating system 16 is connected to the elevator car.

In FIG. 1, the passage of the hoisting ropes is as follows: One end of the hoisting ropes 3 is fixed to the diverting pulley 15 and/or any suspension arrangement for said diverting pulley. Diverting pulleys 14 and 15 form the compensating system 16 in FIG. 1. The compensating system 16 is disposed in the machine room 17 of the elevator. From diverting pulley 15 the hoisting ropes 3 run upwards encountering the other diverting pulley 14 of the compensating system 16, which the rope passes around via the rope grooves in the diverting pulley 14. These rope grooves can be coated or uncoated, e.g., with friction increasing material, such as polyurethane or other appropriate material. All the diverting pulleys of the elevator or only some and/or the traction sheave can be coated with said material. After passing around the diverting pulley 14, the ropes continue downwards in the elevator shaft to the diverting pulley 10 mounted on the elevator car 1, and having passed around this pulley the hoisting ropes 3 run across the top of the elevator car 1 to diverting pulley 9, which is mounted on the elevator car 1 and to the other side of the elevator shaft. The passage of the hoisting ropes 3 to the other side of the elevator shaft is arranged by means of diverting pulleys 10 and 9, a preferred way of arranging the passage of the hoisting rope across the elevator car 1 being diagonally via the centre of mass of the elevator car. After passing around diverting pulley 9 the rope returns upwards to the hoisting machine 4 located in the machine room 17 and to the traction sheave 5 of said machine. The diverting pulleys 14,10,9 together with the traction sheave 5 of the hoisting machine 4 form the suspension arrangement above the elevator car, the suspension ratio of which is the same as that of the suspension arrangement below the elevator car, said suspension ratio being 2:1 in FIG. 1. The first rope tension $T_1$ acts on the part of the hoisting ropes above the elevator car. After passing around the traction sheave 5 the ropes continue their passage along the elevator shaft to the diverting pulley 8, said diverting pulley 8 being advantageously disposed in the lower part of the elevator shaft. After passing around the diverting pulley 8 the ropes 3 continue upwards to the diverting pulley 11 mounted on the elevator car, said diverting pulley not being visible in FIG. 1. After passing around the diverting pulley 11 the hoisting ropes continue their passage, in a similar manner as the roping above the elevator car 1, across the elevator car 1 to the diverting pulley 12 positioned on the other side of the elevator car and at the same time the hoisting ropes transfer to the other side of the elevator shaft. After passing around the diverting pulley 12, the hoisting ropes 3 continue downwards to the diverting pulley 13 in the lower part of the elevator shaft, and having passed around this pulley continue and return to the other diverting pulley 15 of the compensating system 16 in the machine room 17 of the elevator, and having passed around said diverting pulley 15 the hoisting ropes run to the fixing point of the other end of the hoisting rope, said fixing point being located in a suitable place in the machine room 17 or in the elevator shaft. The diverting pulleys 8,11,12,13 form the suspension arrangement of the hoisting ropes below the elevator car and a part of the roping. The second rope tension $T_2$ of the hoisting rope acts on this part of the hoisting ropes below the elevator car. The diverting pulleys of the lower part of the elevator shaft can be immovably fixed to the frame structure formed by the guide rails 2 or to a beam structure located at the lower end of the elevator shaft or each one separately to the lower part of the elevator shaft or to any other fixing arrangement suited to the purpose. The diverting pulleys on the elevator car can be immovably fixed to the frame structure of the elevator car 1, such as, e.g., to the car sling, or to a beam structure or beam structures on the elevator car or each one separately to the elevator car or to any other fixing arrangement suited to the purpose. The diverting pulleys can also be modular in structure, e.g., in such a way that they are separate modular structures, such as, e.g., of the cassette type, that are immovably fixed to the shaft structures of the elevator, to the structures of the elevator car and/or of car sling or to another appropriate place in the elevator shaft, or in its proximity, or in connection with the elevator car and/or in the machine room of the elevator. The diverting pulleys located in the elevator shaft and the devices of the hoisting machine and/or the diverting pulleys connected to the elevator car can be disposed either all on one side of the elevator car in a space between the elevator car and the elevator shaft or otherwise they can be disposed on different sides of the elevator car in the manner desired.

The drive machine 4 placed in the machine room 17 is preferably of a flat construction, in other words the machine has a small thickness dimension as compared to its width and/or height. In the elevator without counterweight of the invention, it is possible to use a drive machine 4 of almost any type and design that fits into the space intended for it. For example, it is possible to use a geared or gearless machine. The machine may be of a compact and/or flat size. In the suspension solutions according to the invention, the rope speed is often high compared to the speed of the elevator, so it is possible to use even unsophisticated machine types as the basic machine solution. The machine room of the elevator is preferably provided with equipment required for the supply of power to the motor driving traction sheave 5 as well as equipment needed for elevator control, both of which can be placed in a common instrument panel 6 or mounted separately from each other or integrated partly or wholly with the drive machine 4. A preferred solution is a gearless machine comprising a permanent magnet motor. FIG. 1 illustrates a preferred suspension solution in which the suspension ratio of the diverting pulleys above the elevator and the diverting pulleys below the elevator car is the same 2:1 suspension in both cases. To visualize this ratio in practice, it means the ratio of the distance traveled by the hoisting rope to the distance traveled by the car. The suspension above the elevator car 1 is implemented by means of the diverting pulleys 14,10,9 and the traction sheave 5 and the suspension arrangement below the elevator car 1 is implemented by means of the diverting pulleys 13,12,11,8. Other suspension arrangements can also be used to implement the invention, such as, e.g., larger suspension ratios, which are implemented by means of a number of diverting pulleys above and below the elevator car. The elevator of the invention can also be implemented as a solution without machine room or the machine may be mounted to be movable together with the elevator. It is advantageous to place the compensating system 16 in the upper part of the elevator, preferably in the machine room, especially in elevators with a high travel height, which elevators are usually also fast in terms of travel speed. In that case, the placement of the compensating system according to the invention results in a considerable reduction in the overall rope elongation of the hoisting ropes of the elevator, because with this placement of the compensating system the upper portion of the hoisting ropes, i.e. the portion located above the compensating system, in which there is greater rope tension, becomes shorter. The portion of the hoisting ropes below the compensating system, however, then increases. Placing the compensating system in the machine room also enables easy access to it.

The compensating system 16 for rope force in the elevator that is presented in FIG. 1 compensates rope elongation by means of the movement of the diverting pulley 15. Diverting pulley 15 moves a limited distance thereby equalizing elongations of the hoisting ropes 3. Additionally, the arrangement in question keeps the rope tension on the traction sheave 5 constant, so that the ratio between the first and second rope tension, the $T_1/T_2$ ratio, in the case of FIG. 1 is approximately 2/1. Diverting pulley 15, which in FIG. 1 functions as a compensating pulley, can be controlled by means of guide rails to stay on its desired track, especially in situations in which the compensating system 16 receives a powerful impact, such as, e.g., during wedge gripping of the elevator. By means of the guides of diverting pulley 15, the distance between the elevator car and the compensating system can be kept to that desired and movement of the compensating system can be kept under control. The guide rails used for the compensating system can be almost any type of guide rails suited to the purpose, such as, e.g., guide rails made of metal or other material suitable for the purpose or, e.g., rope guides. A buffer can also be fitted to the compensating system 16 to dampen the impacts of the diverting pulleys of the compensating system and/or to prevent slackening of the compensating system. The buffer used can be disposed, e.g., in such a way that the compensating pulley 15 remains supported by the buffer before the rope elongation of the hoisting ropes has had time to fully unlay into the hoisting ropes, especially into the part of the ropes above the elevator car. One design criterion in the elevator of the invention has been to ensure that the compensating system is prevented from feeding rope from the compensating system in the direction of the portions of rope below the elevator car when ranging outside the normal compensation range of the compensating system, thereby maintaining a certain tension in the hoisting ropes. It is also possible to implement the compensating system 16 differently than presented in the foregoing example, such as with more complex suspension arrangements in the compensating system, such as, e.g., by arranging different suspension ratios between the diverting pulleys of the compensating system. It is also possible to use a lever suited to the purpose, compensating pulleys or other rope tension compensating arrangement suited to the purpose, or a hydraulic rope force compensating device as the compensating system 16. A preferred embodiment of the elevator with a 2:1 suspension ratio presented in FIG. 1 is an elevator with a speed of approximately 6 m/s and a movable mass, which consists of the mass of the car and its equipment as well as the mass of the maximum load, of about 4000 kg, and in which elevator only six elevator hoisting ropes each of about 13 mm in diameter are needed. The preferred areas of application for the elevator of the invention with a suspension ratio of 2:1 are elevators whose speed is in a range above 4 m/s.

FIG. 2 presents a diagrammatic illustration of the structure of an elevator according to the invention. The elevator presented in FIG. 2 resembles the elevator in FIG. 1 with the difference that the compensating system 216 of the elevator without counterweight, the hoisting machine 204 and the equipment required for the supply of power to the motor as well as equipment needed for elevator control 206 are advantageously disposed in the elevator shaft. The elevator shown in FIG. 2 is an elevator without machine room and the elevator presented in the figure is a traction sheave elevator with machine above and without counterweight, with an elevator car 201 moving along guide rails 202, as in FIG. 1. The passage of the hoisting ropes 203 in FIG. 2 is similar to that in FIG. 1. The difference to the elevator shown in FIG. 1 is how many times the hoisting ropes 203 pass between the elevator car 201 and the diverting pulleys above the elevator car as well as between the elevator car and the diverting pulleys below the elevator car. FIG. 2 presents an elevator with a suspension ratio of 6:1, in which the suspension ratio above the elevator car has been increased to a ratio of 6:1 by means of the diverting pulleys 214,213,212,211,210,209 and the traction sheave 205. The suspension ratio below the elevator car is the same as above it, i.e. also 6:1. This is achieved by means of diverting pulleys 208,217,218,219,220,221,222. The compensating system 216 shown in FIG. 2 is similar to that in FIG. 1 and includes diverting pulleys 214 and 215, the operation of said compensating system 216 being similar to that presented in FIG. 1. A different type of compensating system to that now presented in the example can also be used in the elevator of FIG. 2.

A preferred embodiment of the elevator without counterweight with a 6:1 suspension ratio presented in FIG. 2 is an elevator with a speed of 1.8 m/s and a movable mass, which consists of the mass of the car and its equipment as well as the mass of the maximum load, of about 2000 kg, and in which elevator only five hoisting ropes each of about 8 mm in diameter are needed. The preferred areas of application for the elevator of the invention with a suspension ratio of 6:1 are elevators whose speed is in a range above 1 m/s.

FIG. 3 presents a diagrammatic illustration of the structure of an elevator according to the invention. The elevator is preferably an elevator without machine room, in which the drive machine 304 and the compensating system 316 are disposed in the elevator shaft. In the figure, the compensating system 316 is located in the lower part of the elevator shaft, but can just as well be situated in the upper part of the elevator shaft or in the machine room. The elevator shown in the figure is a traction sheave elevator without counterweight and with machine above, in which the elevator car 301 moves along elevator car guide rails 302. The passage of the hoisting ropes in FIG. 3 is similar to that presented in FIG. 1, but in the example presented in FIG. 3, the hoisting ropes of the elevator are advantageously arranged to pass on one side of the elevator car by means of the diverting pulleys 308, 309, 310, 311, 312, and 313, and the compensating system 316 and its diverting pulleys 314 and 315, and the traction sheave 305 of the hoisting machine 304. The elevator presented in FIG. 3 is an elevator suspended with a suspension ratio of 2:1, wherein the suspension ratio above and below the elevator car is the same 2:1 in both cases. FIG. 3 presents the compensating system 316 of the elevator of the invention, which contains a locking arrangement according to the invention. In FIG. 3, the moving diverting pulley 315 of the compensating system is preferably arranged to travel on its track along the guides 318, and the diverting pulley 315 is preferably suspended on the frame 317, by means of which it moves along the guides 318. A locking means 319, preferably gripping brake elements, is fitted to the frame 317 of the diverting pulley 315, said braking elements preferably gripping the guides 318 or other similar place for stopping and/or retarding movement of the compensating system. In situations where the elevator safety gear grips or the elevator runs onto the buffer or other similar situations, the ratio between the speed of the hoisting rope and the speed of the elevator car changes suddenly or tries to change suddenly. In such cases, a sudden strong force is exerted on the compensating system, which causes a sudden movement of the compensating pulleys of the compensating system or the like, which may result in loosening or damage of the hoisting ropes or part of them. Another result may be damage to the compensating pulleys, or similar, of the compensating system or damage to their track. This problem is especially prominent in elevators with high speeds and/or large travel heights. The problem is solved according to the invention by arranging locking 319 for the diverting pulley 315 of the compensating system, or similar, or for its frame 317, said locking preferably gripping the diverting pulley 315 or a similar track or the like, preferably guide 318, in a situation where the speed of movement or the acceleration of the compensating system exceeds a pre-set limit value.

FIG. 4 presents a diagrammatic illustration of an elevator according to the invention. The elevator is preferably an elevator without machine room, in which the drive machine 404 and compensating system are disposed in the elevator shaft. The elevator shown in the figure is a traction sheave elevator without counterweight and with machine above, in which the elevator car 401 moves along guide rails 402. The compensating system 416 is disposed in the lower part of the elevator shaft. The compensating system 416 in FIG. 4 is gravity-assisted and it is possible to add additional weights to it if necessary to improve the operation of the compensation system. An additional force on the compensating system 416 is arranged, said additional force acting substantially in the same direction as the first rope tension ($T_1$). By means of the additional force, the second rope tension $T_2$ is increased in relation to the first rope tension $T_1$.

In FIG. 4, the passage of the hoisting ropes is as follows: One end of the hoisting ropes 403 is fixed to the diverting pulley 417 and/or any suspension arrangement for it, said diverting pulley 417 being fitted to rest on the rope portion coming downwards from the diverting pulley 418, which hoisting rope portion passes around diverting pulley 417 and runs further to the fixing point of the other end of the hoisting ropes 403 in the elevator, shaft. The compensating system 416 is fitted in place in the elevator shaft. From diverting pulley 415 the hoisting ropes 403 run upwards encountering the diverting pulley 414, which is fitted in place in the upper part of the elevator shaft, and around which the rope passes via the rope grooves in the diverting pulley 414. After passing around the diverting pulley 414, the ropes continue downwards to the diverting pulley 413 mounted on the elevator car 401, and having passed around this pulley the ropes 403 run across the elevator car 401 to diverting pulley 412, which is mounted on the elevator car 401 and to the other side of the elevator shaft. The passage of the hoisting ropes 403 to the other side of the elevator shaft is arranged by means of diverting pulleys 413 and 412. After passing around diverting pulley 412 the rope returns upwards to the diverting pulley 411 fitted in place in the upper part of the elevator shaft, and after passing around this pulley returns to the diverting pulley 410 mounted on the elevator car, after passing around which it continues across the elevator car to the diverting pulley 409 mounted on the elevator car, and at the same time to the other side of the elevator shaft. Having passed around the diverting pulley 409 the hoisting ropes run further to the hoisting machine 404 fitted in place in the upper part of the elevator shaft and to its traction sheave 405. The diverting pulleys 414,413,412,411, 410,409 together with the traction sheave 405 of the hoisting machine 404 form the suspension arrangement above the elevator car, the suspension ratio of which is the same as that of the suspension arrangement below the elevator car, said suspension ratio being 4:1 in FIG. 4. The first rope tension $T_1$ acts on the part of the hoisting ropes above the elevator car. After passing around the traction sheave 405 the hoisting ropes go further to the diverting pulley 408 fitted in place in the lower part of the elevator shaft. After passing around diverting pulley 408 the ropes 403 continue upwards to the diverting pulley 422 mounted on the elevator car. After passing around the diverting pulley 422 the hoisting ropes continue their passage, in a similar manner as the roping above the elevator car 401, under the elevator car 401 to the diverting pulley 419 positioned on the other side of the elevator car and at the same time the hoisting ropes 403 transfer to the other side of the elevator shaft. After passing around the diverting pulley 419 the hoisting ropes 403 continue downwards to the diverting pulley 420 in the lower part of the elevator shaft, and having passed around it continue back to the elevator car 401 and to the diverting pulley 421 fixed to the elevator car, and after passing around this pulley the hoisting ropes continue below the elevator car to the diverting pulley 418 positioned on the other side of the elevator car and at the same time the hoisting ropes 403 transfer back to the other side of the elevator shaft. Having passed around diverting pulley 418 the hoisting rope runs further to the other diverting pulley 417 of the compensating system 416, and after passing around the diverting pulley 417 the hoisting ropes continue to the fixing point for the other end of the hoisting ropes, which is in a suitable place in the elevator shaft. The diverting pulleys 408,422,419,420,421,418,417 form the suspension arrangement of the hoisting ropes below the elevator car and a part of the roping. The second rope tension $T_2$ of the hoisting rope acts on this part of the hoisting ropes below the elevator car. The diverting pulleys of the lower part of the elevator shaft can be immovably fixed to the frame structure formed by the guide rails 402 or to a beam structure located at the lower end of the elevator shaft or each one separately to the lower part of the elevator shaft or to any other fixing arrangement suited to the purpose. The diverting pulleys on the elevator car can be immovably fixed to the frame structure of the elevator car 401, such as, e.g., to the car sling, or to a beam structure or beam structures on the elevator car or each one separately to the elevator car or to any other fixing arrangement suited to the purpose. The diverting pulleys can also be modular in structure, e.g., in such a way that they are separate modular structures, such as, e.g., of the cassette type, that are immovably fixed to the shaft structures of the elevator, to the structures of the elevator car and/or car sling or to another appropriate place in the elevator shaft, or in its proximity, or in connection with the elevator car and/or in the machine room of the elevator. The diverting pulleys located in the elevator shaft and the devices of the hoisting machine and/or the diverting pulleys connected to the elevator car can be disposed either all on one side of the elevator car in a space between the elevator car and the elevator shaft or otherwise they can be disposed on different sides of the elevator car in the manner desired.

In the example presented in FIG. 5, the elevator roping and diverting pulleys as well as the hoisting machine and its equipment are disposed on the sides of the elevator car symmetrically, thus there is no diverting pulley or hoisting machine directly above and/or below the path of travel of the elevator car. This allows, e.g., a smaller safety clearance above, and/or below the elevator car. In addition, the components of the elevator, such as the diverting pulleys and the hoisting machine and the passage of the hoisting rope, are positioned symmetrically on the different sides of the elevator shaft. A hydraulic compensating system is shown in the elevator presented in FIG. 5, in which compensating system any hydraulic fluid suited to the purpose can be used as hydraulic fluid, such as, e.g., oil, water, glycol, or other fluid suited to the purpose. The hydraulic compensating system in FIG. 5 includes at least cylinders 514 and 513, to which the free ends of the hoisting rope 503 of the elevator are fixed. Cylinders 513 and 514 are connected to each other on the piston side by means of a hydraulic hose or pipe 515, so that the hydraulic fluid transfers from cylinder 513 to cylinder 514, or vice versa, depending on each loading situation. By means of the area ratio of cylinders 513, 514, equalization of the ratio between the rope tensions $T_1$ and $T_2$ of the hydraulic compensating system can be defined and adjusted, as presented earlier in conjunction with the other figures. A pressure gauge 518 can also be added to the hydraulic compensating system. By means of the pressure gauge 518 it is possible to obtain the load weighing information of the elevator, by means of which the magnitude of the load in the elevator car can be determined. Equalization and/or compensation of rope tension and/or rope elongation in the compensating system and/or achieving a substantially constant ratio ($T_1/T_2$) between the first and second rope tension can be implemented by means of one or more hydraulic actuators, preferably a cylinder, said actuator acting on the hoisting ropes of the elevator. A choke 517, or similar arrangement, can also be fitted to the hydraulic compensating system for equalizing force divergences that occur suddenly. The choke 517 can be adjustable. The compensating system may also include a hydraulic fluid reservoir, which adds more fluid to the system when required, either automatically or manually. The hydraulic compensating system may also be one or more double-acting hydraulic cylinders, in which equalizing or making constant the rope tensions is implemented, e.g., by means of different chokes on different sides of the piston of the cylinder or in another manner suited to the purpose, such as, e.g., by means of differences in the area ratios of the pistons and by means of chokes. The hydraulic compensating system according to the invention can be situated anywhere in the elevator such as, e.g., in the lower part or upper part of the elevator shaft or in both the lower part and top part of the elevator shaft or in the machine room of the elevator or partly in the machine room of the elevator and partly in the elevator shaft or in some other manner suited to the purpose. The hydraulic compensating system can also be locked into position, e.g., by means of an adjustable choke so that operation of the compensating system is prevented. A preferred embodiment of the elevator with a 4:1 suspension ratio presented in FIG. 5 is an elevator with a speed of approximately 4 m/s and a movable mass, which consists of the mass of the car and its equipment as well as the mass of the maximum load, of about 4000 kg, and in which elevator only eight hoisting ropes each of about 8 mm in diameter are needed. The preferred areas of application for the elevator of the invention with a suspension ratio of 4:1 are elevators whose speed is in the range 1.6 m/s-4.0 m/s.

FIG. 6 presents an elevator of the invention, in which two elevator cars without counterweight and their hoisting machines are fitted to travel one above the other in the same elevator shaft. The suspension arrangement of both elevators is similar with the only difference being that the ropings run on the elevator cars on different sides of the elevator shaft. Placing more than one elevator without counterweight in the same elevator shaft is often problematic in respect of lay-out and often also requires an increase in the shaft space, especially in high-rise buildings and fast elevators, in which placement of the hoisting ropes, car cables and any compensating sheaves increases the need for space in the elevator shaft. Also safety clearances upwards and downwards as well as between the elevator cars can be difficult to control or at least some of them must be made large because of the counterweights. These problems are solved in the example presented in FIG. 6 so that two elevator cars 601 without counterweight are placed to travel one above the other in the same elevator shaft, with the hoisting machines 604 and compensating systems 616 of said elevator cars being placed in the machine room 617 of the elevator. Preferably, if there are several elevators one above the other in the same elevator shaft, at least one of them is without counterweight. It is even more advantageous if all the elevators are without counterweight. Preferably at least two of the elevators traveling in the same elevator shaft serve one or more floors common to the elevators. This is in order to make the elevator system as efficient as possible. More than two elevators can be placed to travel one above the other in the same elevator shaft. In addition, it is possible to implement the type of solutions in which the hoisting machines and their control equipment and the compensating system of the elevator are disposed in the elevator shaft. Furthermore, it is possible to implement two-car elevator solutions in the manner presented above, in which several elevator cars travel in the same car sling. In a similar way it is also possible to implement two-car elevator solutions or the movement of elevator cars in respect of each other in the car sling of a two-car elevator. In a two-car elevator both elevator cars can have their own machine or they can have the same hoisting machine. In this context an elevator car means an independent unit/structure suspended from the rope. A two-car elevator has two passenger compartments, one above the other.

FIG. 7 presents a locking/dampening means of a hydraulic compensating system. The elevator presented in the figure is consistent with the elevator presented in FIG. 3 and the passage of the ropes is similar to that presented in FIG. 3. FIG. 7 differs from FIG. 3 in respect of the compensating system. A hydraulically operating locking means and/or dampening means 720, which is preferably a hydraulic cylinder and more preferably a double-acting hydraulic cylinder consistent with FIG. 5, is arranged for the compensating system 716 of the elevator according to the invention. The locking means/dampening means 720 is arranged between the moving and fixed part of the compensating system, said fixed part in the case of FIG. 7 being the fixing point in the elevator shaft of the hoisting ropes 703 and the hydraulic cylinder and said moving part being the diverting pulley 715 with its frame 717. The diverting pulley 715 is guided to move on its track on guide rails 718. The movement of the compensating system for its part is limited by stopping means 719 at the ends of the guide rails 718. A locking means/dampening means 720 of the elevator according to the invention is arranged for the compensating system 716 in FIG. 7. Adjustable chokes 721 are arranged in connection with the double-acting hydraulic cylinder functioning as the locking means/dampening means 720 in FIG. 7 for stopping and/or retarding movement of the compensating system. Both sides of the piston of the hydraulic cylinder in the locking means/dampening means are connected to each other and to the hydraulic reservoir 723 by means of piping 722. The adjustable chokes 721 are fitted to this piping 722 and there is at least one of them. Dampening or locking can also be implemented in another manner suited to the purpose in the locking means/dampening means. In situations where the elevator safety gear grips or the elevator runs onto the buffer or other similar situations, in which the ratio between the speed of the hoisting rope and the speed of the elevator car changes suddenly or tries to change suddenly, a sudden strong force is exerted on the compensating system, which causes a sudden movement of the compensating pulleys of the compensating system or the like, which may result in loosening or damage of the hoisting ropes or part of them.

Another result may be damage to the compensating pulleys, or similar, of the compensating system or damage to their track. This problem is especially prominent in elevators with high speeds and/or large travel heights. This problem is solved according to the invention by the hydraulic locking means/dampening means 720 of the compensating system, the purpose of which is to prevent the speed of movement or the acceleration of the compensating system exceeding a pre-set limit value. The mass of the compensating pulleys and frames of the compensating system also influences the operation of the locking means/dampening means needed. Depending on how the pulleys of the compensating system are positioned to operate, the mass of the pulleys either lightens the movement of the compensating system or increases it. In the case of FIG. 7, the mass of the pulley assembly of the compensating system and frame of said assembly resists movement of the compensating system upwards and increases it downwards. This must be taken into account when setting the limit values for the hydraulic locking means/dampening means. The adjustment and limit values are implemented always by means of one choke or the like. The compensating system of the invention with its locking means/dampening means can be situated in any place suited to the purpose in the elevator shaft or in the machine room or partly in both. The operation of the locking means/dampening means is adjustable and an effective minimum speed can be set, e.g., by means of adjustable chokes. In practice, the dampening of means 720 starts at almost the zero speed of diverting pulley 715 of the compensating system and frame 717 of said diverting pulley owing to the choking in the locking means/dampening means 720 and/or to the inertia of the fluid moving in the hydraulic circuit.

FIG. 7 also shows elevator car 701, elevator car guide rails 702, hoisting machine 704, traction sheave 705, common instrument panel 706, and diverting pulleys 708, 709, 710, 711, 712, 713, and 714. As shown in FIG. 7, diverting pulley 714 may be part of compensating system 716. In addition, FIG. 7 shows additional force $T_3$, which may be caused, for example, by the mass of diverting pulley 715, the suspension arrangement of diverting pulley 715 (e.g., frame 717), and/or additional weights connected to diverting pulley 715.

When the elevator car is suspended with a small suspension ratio, such as, e.g., 1:1, 2:1, 3:1, or 4:1, diverting pulleys of a large diameter and hoisting ropes of a large thickness can be used. Below the elevator car it is possible to use smaller diverting pulleys if necessary, because the tension in the hoisting ropes is smaller than in the portion above the elevator car, allowing smaller hoisting rope deflection radiuses to be used. In elevators with a small space below the elevator car, it is advantageous to use diverting pulleys of a small diameter in the rope portion below the elevator car, because by using a rope force compensating system according to the invention the tension of the rope portion below the elevator car can be maintained at a constant level that is lower by the ratio $T_1/T_2$ than the tension in the rope portion above the elevator car. This makes it possible to reduce the diameters of the diverting pulleys in the rope portion below the elevator car without causing any substantial loss regarding the useful life of the hoisting ropes. For example, the ratio of the diameter D of the diverting pulley to the diameter d of the rope used may be $D/d<40$, and preferably the D/d ratio may be only $D/d=25 \ldots 30$ when the ratio of the diameter of the diverting pulleys in the rope portion above the elevator car to the diameter of the hoisting ropes is $D/d=40$. By using diverting pulleys of a smaller diameter, the space required below the elevator car can be reduced to a very small size, which may preferably be only 200 mm.

A preferred embodiment of the elevator of the invention is an elevator with machine room, in which the drive machine has a coated traction sheave. The hoisting machine has a traction sheave and a diverting pulley, in which machine the traction sheave and diverting pulley are fitted at a correct angle relative to each other. The hoisting machine and its control equipment are fitted in place in the machine room of the elevator, in which room the compensating system of the elevator is also fitted. The elevator is implemented without counterweight with a suspension ratio of 2:1 such that both the roping suspension ratio above the elevator car and the roping suspension ratio below the elevator car is 2:1, and that the roping of the elevator runs in the space between one of the walls of the elevator car and the wall of the elevator shaft. The elevator has a compensating system, which maintains the ratio $T_1/T_2$ between the rope tensions at a constant ratio of about 2:1. The compensating system of the elevator contains at least one locking means, preferably brake elements, and/or a slack rope prevention means for preventing uncontrolled slackening of the hoisting ropes and/or uncontrolled movement of the compensating system, said slack rope prevention means preferably being a buffer. The additional force caused by the masses of the diverting pulley and its suspension arrangement and of additional weights connected to the diverting pulley are utilized in the compensating system, said additional force being substantially directed in the same direction as the first rope tension $T_1$, and which additional force increases the rope tension $T_2$, thereby making the ratio $T_1/T_2$ more advantageous.

It is obvious to the person skilled in the art that different embodiments of the invention are not limited to the example described above, but that they may be varied within the scope of the claims presented below. For instance, the number of times the hoisting ropes are passed between the upper part of the elevator shaft and the elevator car and the diverting pulleys below it and the elevator car is not a very decisive question, although it is possible to achieve some additional advantages by using multiple rope passages. In general, applications are so implemented that the ropes go to the elevator car from above as many times as from below, so that the suspension ratios of diverting pulleys going upwards and diverting pulleys going downwards are the same. It is also obvious that the hoisting ropes need not necessarily be passed under the car. In accordance with the examples described above, the skilled person can vary the embodiment of the invention, while the traction sheaves and rope pulleys, instead of being coated metal pulleys may also be uncoated metal pulleys or uncoated pulleys made of some other material suited to the purpose.

It is further obvious to the person skilled in the art that the traction sheaves and rope pulleys used in the invention, whether metallic or made of some other material suited to the purpose, which function as diverting pulleys and which are coated with a non-metallic material at least in the area of their grooves, may be implemented using a coating material consisting of, e.g., rubber, plastic, polyurethane or some other material suited to the purpose. It is also obvious to the person skilled in the art that in rapid movements of the compensating system, which occur, e.g., during wedge gripping of the elevator, the additional force of the invention also causes an inertial term in the rope force, which tries to resist the movement of the compensating system. The greater the acceleration of the diverting pulley/diverting pulleys and any additional weights of the compensating system, the greater is the significance of the inertia mass, which tries to resist the movement of the compensating system and to reduce the impact on the buffer of the compensating system, because the movement of the compensating system occurs against the force of gravity. It is also obvious to the person skilled in the art that the elevator car and the machine unit may be laid out in the cross-section of the elevator shaft in a manner differing from the lay-out described in the examples. Such a different lay-out may be, e.g., one in which the machine is located behind the car as seen from the shaft door and the ropes are passed under the car diagonally relative to the bottom of the car. Passing the ropes under the car in a diagonal or otherwise oblique direction relative to the form of the bottom provides an advantage when the suspension of the car on the ropes is to be made symmetrical relative to the centre of mass in other types of suspension lay-outs as well.

It is also obvious to the person skilled in the art that the equipment required for the supply of power to the motor and the equipment needed for elevator control can be placed elsewhere than in connection with the machine unit, e.g., in a separate instrument panel, or equipment needed for control can be implemented as separate units which can be disposed in different places in the elevator shaft and/or in other parts of the building. It is likewise obvious to the skilled person that an elevator applying the invention may be equipped differently from the examples described above. It is further obvious to the skilled person that the elevator of the invention can be implemented using almost any type of flexible hoisting means as hoisting ropes, e.g., flexible rope of one or more strands, flat belt, cogged belt, trapezoidal belt or some other type of belt applicable to the purpose. It is also obvious to the skilled person that, instead of using ropes with a filler, the invention may be implemented using ropes without filler, which are either lubricated or unlubricated. In addition, It is also obvious to the skilled person that the ropes may be twisted in many different ways.

It is also obvious to the person skilled in the art that the elevator of the invention can be implemented using different roping arrangements between the traction sheave and the diverting pulley/diverting pulleys to increase the contact angle $\alpha$ than those described as examples. For example, it is possible to dispose the diverting pulley/diverting pulleys, the traction sheave and the hoisting ropes in other ways than in the roping arrangements described in the examples. It is also obvious to the skilled person that, in the elevator of the invention, the elevator may also be provided with a counterweight, in which elevator the counterweight has, e.g., a weight advantageously below that of the car and is suspended with a separate roping, the elevator car being suspended partly by means of the hoisting ropes and partly by means of the counterweight and its roping.

Due to the bearing resistance of the rope pulleys used as diverting pulleys and to the friction between the ropes and the rope sheaves and possible losses occurring in the compensating system, the ratio between the rope tensions may deviate somewhat from the nominal ratio of the compensating system. Even a deviation of 5% will not involve any significant disadvantage because in any case the elevator must have a certain inbuilt robustness.

What is claimed is:

1. An elevator, comprising:

an elevator car;

a set of hoisting ropes;

a traction sheave; and a compensating device;

wherein the elevator car is at least partially supported using the set of hoisting ropes, wherein the set of hoisting ropes includes at least one rope, wherein the traction sheave moves the elevator car using the set of hoisting ropes, wherein the set of hoisting ropes includes first and second rope portions, wherein the elevator car includes one or more first diverting pulleys from which the first rope portions extend upward, wherein the elevator car includes one or more second diverting pulleys from which the second rope portions extend downward, wherein the first rope portions apply a first rope tension to the traction sheave, wherein the second rope portions apply a second rope tension to the traction sheave, the second rope tension being different from the first rope tension, wherein the compensating device applies an auxiliary force substantially in a same direction as the first rope tension, wherein the compensating device includes:

a third diverting pulley; and a fourth diverting pulley;

wherein the first portions further extend from one of the one or more first diverting pulleys to the third diverting pulley, wherein the first portions further extend from the third diverting pulley to the fourth pulley, wherein the second portions further extend from one of the one or more second diverting pulleys to the fourth diverting pulley, wherein a force in addition to the first rope tension and second rope tension is arranged in the compensating system, wherein the force is applied in essentially in a same direction as the first rope tension, and wherein the force is caused by weight added to the compensating device.

2. The elevator of claim 1, wherein the elevator is without counterweight.

3. The elevator of claim 1, wherein the compensating device includes:

a hydraulic unit;

wherein the hydraulic unit applies force on a first end of the set of hoisting ropes so that the first rope portions apply the first rope tension, and wherein the hydraulic unit acts-applies force on a second end of the set of hoisting ropes so that the second rope portions are the second rope tension that is different from the first rope tension.

4. The elevator of claim 1, wherein the compensating device includes a device to dampen, lock, or dampen and lock the compensating system.

5. The elevator of claim 4, wherein in a situation where an acceleration, a speed, or the acceleration and the speed of the compensating system increases above a pre-defined limit value, the device retards or prevents operation of the compensating system.

* * * * *